US010799776B1

(12) United States Patent
Martens et al.

(10) Patent No.: US 10,799,776 B1
(45) Date of Patent: Oct. 13, 2020

(54) POLYMER-FILLED HOLLOW IRON WITH THIN BACK

(71) Applicant: Acushnet Company, Fairhaven, MA (US)

(72) Inventors: Grant M. Martens, Carlsbad, CA (US); Tony Luna, Carlsbad, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 0 days.

(21) Appl. No.: 16/432,659

(22) Filed: Jun. 5, 2019

(51) Int. Cl.
*A63B 53/04* (2015.01)
*A63B 53/08* (2015.01)

(52) U.S. Cl.
CPC ..... *A63B 53/047* (2013.01); *A63B 53/0475* (2013.01); *A63B 53/08* (2013.01); *A63B 2053/0433* (2013.01)

(58) Field of Classification Search
CPC ..... A63B 2053/0433; A63B 53/047; A63B 53/0475; A63B 53/08
See application file for complete search history.

(56) References Cited

U.S. PATENT DOCUMENTS

| | | | | |
|---|---|---|---|---|
| 4,523,759 | A * | 6/1985 | Igarashi | A63B 53/04 473/346 |
| 4,928,972 | A * | 5/1990 | Nakanishi | A63B 53/04 473/332 |
| 9,265,995 | B2 * | 2/2016 | Wahl | A63B 60/00 |
| 9,802,091 | B2 * | 10/2017 | Taylor | A63B 53/0475 |
| 9,808,685 | B1 * | 11/2017 | Westrum | A63B 53/047 |
| 10,420,991 | B2 * | 9/2019 | Petersen | A63B 60/54 |
| RE47,653 | E * | 10/2019 | Wahl | A63B 53/047 |
| 2005/0255936 | A1 * | 11/2005 | Huang | A63B 60/02 473/329 |
| 2013/0252754 | A1 * | 9/2013 | Bazzel | A63B 53/047 473/290 |
| 2017/0319914 | A1 * | 11/2017 | Jertson | A63B 53/04 |
| 2019/0001204 | A1 * | 1/2019 | Golden | A63B 53/0475 |

* cited by examiner

*Primary Examiner* — Stephen L Blau

(57) ABSTRACT

An iron-type golf club head having a thin back portion and filled with a polymer material. For example, the iron-type golf club may include a sole, a toe portion attached at least partially to the sole, a heel portion attached at least partially to the sole, a striking face attached at least partially to the sole, the striking face having a maximum face thickness, a topline portion attached at least partially to the toe portion, the heel portion, and the striking face, a substantially planar back portion attached at least partially to the topline portion and sole. The back portion may have a maximum back thickness less than the maximum face thickness. The golf club head may also have a cavity formed between the sole, the toe portion, the heel portion, the striking face, the topline portion, and the back portion. The cavity may be filled with a polymer material.

20 Claims, 9 Drawing Sheets

| Property | Club Head 1 | Club Head 2 | Club Head 3 | Club Head 4 | Club Head 5 | Club Head 6 | Club Head 7 | Club Head 8 | Club Head 9 |
|---|---|---|---|---|---|---|---|---|---|
| Striking Face Thickness (mm) | 1.35 | 1.35 | 1.35 | 1.6 | 1.6 | 1.35 | 1.35 | 1.6 | 1.6 |
| Back Thickness (mm) | 1 | 0.55 | 1 | 0.55 | 0.55 | 1 | 0.55 | 1 | 0.55 |
| Polymer Young's Modulus (MPa) | 100 | 100 | 80 | 100 | 50 | N/A | N/A | N/A | N/A |
| Back Striking Face Stress (GPa) | 1.75 | 1.83 | 1.87 | 1.63 | 1.89 | 2.75 | 2.85 | 2.34 | 2.47 |
| COR | 0.816 | 0.8209 | 0.8202 | 0.8114 | 0.8218 | 0.846 | 0.849 | 0.8332 | 0.8364 |
| Spring Factor | 83.2 | 78.295 | 79 | 87.795 | 77.295 | 62.2 | 57.295 | 71.7 | 66.795 |

FIG. 6

POLYMER-FILLED HOLLOW IRON WITH THIN BACK

Because iron type golf clubs constitute a majority of the golf clubs within a golfer's club allotment, improving the performance characteristics of a set of irons may significantly help a golfer to perform better on a golf course. However, due to the inherent limitation of keeping to the traditional size and shape of an iron type golf club, the design space available for improvements in iron-type golf clubs can be limiting. Hence, due to the numerous hurdles that are encountered in attempting to improve the performance of an iron-type golf club head, golf club designers have constantly struggled with even incremental improvements to the performance of these iron-type golf clubs.

One such improvement that is sought for iron-type golf clubs is an improvement to the coefficient of restitution (COR). The COR generally describes energy transfer between the golf club head and the golf ball. A higher COR generally leads to higher ball speeds off the golf club and, thus, a farther distance traveled by a golf ball struck with a high-COR golf club head. A perfectly elastic collision between the golf club head and the golf ball would have a COR of 1. The USGA, however, currently limits golf clubs to have a maximum COR of 0.830. Designing and manufacturing a golf club head having a high COR, but maintaining durability and other performance characteristics of the golf club head continues to be a challenge.

SUMMARY

Examples of the present technology relate to a polymer-filled iron-type golf club that has a thin back portion. In an aspect, the technology relates to an iron-type golf club head that includes a sole, a toe portion attached at least partially to the sole, a heel portion attached at least partially to the sole, a striking face attached at least partially to the sole, the striking face having a maximum face thickness, a topline portion attached at least partially to the toe portion, the heel portion, and the striking face, and a substantially planar back portion attached at least partially to the topline portion and sole. The back portion has a maximum back thickness less than the maximum face thickness and an angle between the striking face and the back portion is between about 10 degrees to about 45 degrees. The golf club head has a cavity formed between the sole, the toe portion, the heel portion, the striking face, the topline portion, and the back portion, wherein the cavity is substantially filled with a polymer material.

In an example, a ratio between the maximum face thickness and the maximum back thickness is between about 2:1 and 3:1. In another example, the iron-type golf club head has a spring factor of less than or equal to about 80. In yet another example, the maximum face thickness is about 1.5 mm and the maximum back thickness is about 0.6 mm. In still another example, the striking face has an average face thickness, the back thickness has an average back thickness, and the average face thickness is greater than the average back thickness. In still yet another example, the polymer material is an injected material that fills at least 95% of the cavity. In a further example, the polymer material has a hardness between Shore 20 A and Shore 60 A.

In another example, the golf club head includes an attachment post extending from the topline portion towards the sole, the attachment post configured to attach the sole to at least one of the striking face, the back portion, the toe portion, or the heel portion. In a further example, the attachment post includes an internal threading to receive a screw; and the sole defines a through hole configured to receive the screw, such that tightening of the screw into the internal threading of the attachment post causes the sole compress the polymer material. In yet another example, the polymer material is a pre-formed polymer shaped to be inserted into the cavity prior to attachment of the sole to the golf club head. In still another example, the attachment post is substantially centered between the toe portion and the heel portion.

In another aspect, the technology relates to an iron-type golf club head that includes a striking face having a face thickness, a topline portion attached at least partially to the striking face, a toe portion attached at least partially to the topline portion, a heel portion attached at least partially to the topline portion, and a back portion attached at least partially to the topline portion. The back portion has a back thickness and an angle between the striking face and the back portion is between about 10 degrees to about 45 degrees. The golf club head also includes a cavity formed between the toe portion, the heel portion, the striking face, the topline portion, and the back portion. The golf club head further includes an attachment post extending from the topline portion into the cavity, a fastener configured to be engage the attachment post, a pre-formed polymer inserted into the cavity; and a sole configured to receive the fastener such that tightening of the fastener causes the sole to compress the pre-formed polymer.

In an example, the attachment post is substantially centered between the toe portion and the heel portion. In another example, the fastener is a screw and the attachment post includes an internal threading to receive the screw. In a further example, compression of the pre-formed polymer causes a preload on the striking face. In still another example, the pre-formed polymer fills at least 95% of the cavity. In still yet another example, a ratio between the face thickness and the back thickness is between about 2:1 and 3:1. In another example, the ratio between the face thickness and the back thickness is about 5:2. In a further example, the face thickness is about 1.5 mm and the back thickness is about 0.6 mm.

In another aspect, the technology relates to a golf club head that includes a striking face having a maximum face thickness, a topline portion attached at least partially to the striking face, a toe portion attached at least partially to the topline portion, a heel portion attached at least partially to the topline portion, and a substantially planar back portion attached at least partially to the topline portion, wherein a ratio between the maximum face thickness of the striking face and a maximum back thickness of the back portion is between about 2:1 and 3:1 and wherein an angle between the striking face and the back portion is between about 10 degrees to about 45 degrees. The golf club head also includes a cavity formed between the toe portion, the heel portion, the striking face, the topline portion, and the back portion. The golf club head further includes an attachment post extending from the topline portion into the cavity, a fastener configured to be received by the attachment post, and a pre-formed polymer inserted into the cavity, and a sole configured to receive the fastener such that tightening of the fastener compresses the pre-formed polymer.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

FIG. 6 depicts a table of data for filled and unfilled irons with varying thicknesses of the striking face and the back portion.

DETAILED DESCRIPTION

As discussed above, improving performance characteristics of iron-type golf clubs is desired to help golfers perform better. Designing golf clubs to increase those performance characteristics while still maintaining the traditional size and shape of an iron-type golf club presents challenges. To improve those golf club characteristics, golf club manufacturers have looked increase the coefficient of restitution (COR). One technique to increase the COR is to make the striking face of the golf club thinner. The thin striking face more easily flexes into a cavity of the golf club head. Thinning the face of the golf club head, however, reduces the durability of the golf club head. For instance, as the striking face becomes thinner, the likelihood of the striking face failing when striking a golf ball increases. In addition, hollow irons with thin faces have traditionally come at the sacrifice of sound and feel of the golf club. To solve some of those problems, polymers have been used to fill golf club heads. Filling a golf club head with a polymer, however, significantly reduced the COR for the golf club head.

The present technology provides for an iron-type golf club that has an improved COR with improved durability. The present technology proceeds against the traditional wisdom that solely thinning of the face is the solution to increased COR. Rather than further thinning the face, the present technology thins the back portion of the golf club head and fills the golf club head with a polymer to allow for an improved energy transfer between the striking face and the back portion. By creating such an improved energy transfer, the COR and durability of the golf club head is improved. According to the present technology, the back of the golf club head is thinner than the striking face of the golf club head, which allows for an improved combined flex and energy transfer between the striking face, polymer, and back portion. For instance, when a golf club head strikes a golf ball, the impact causes the striking face to flex into the polymer, which may generally be incompressible. The polymer transfers that impact energy to the back portion of the golf club. Due to the thinner back portion of the golf club in the present technology, the back portion flexes due to the energy transferred through the polymer. The energy is then transferred back to the golf ball as a spring force.

Figure 1A:
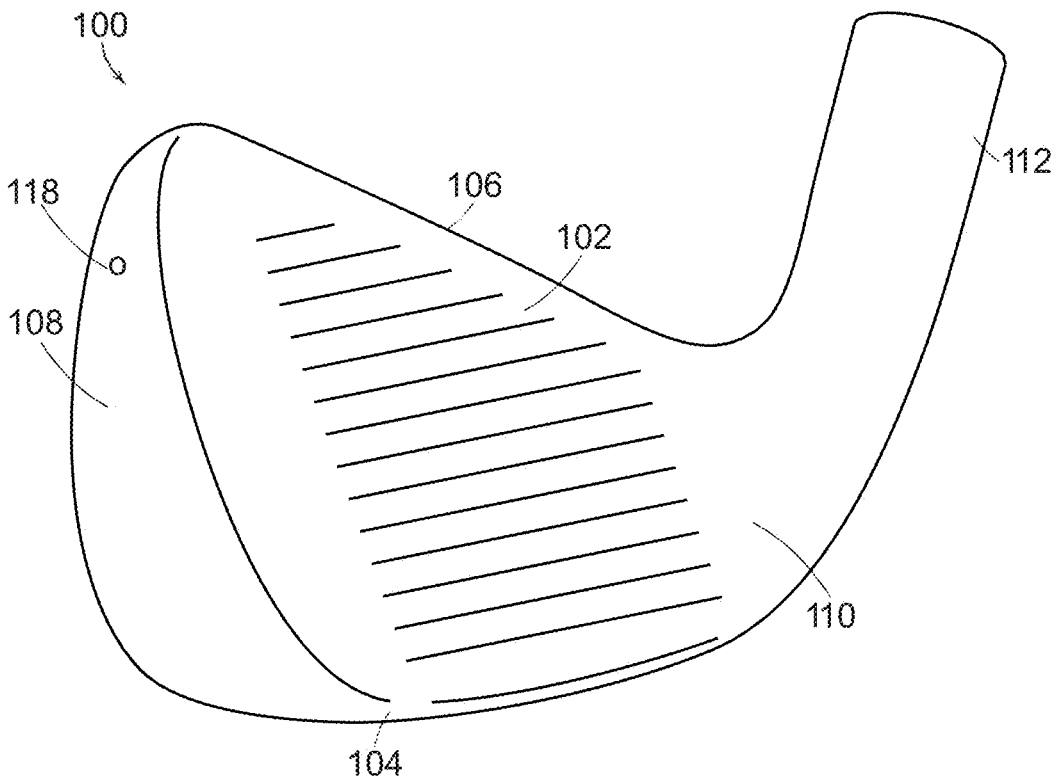
FIG. 1A depicts a perspective view of an example polymer-filled hollow iron-type golf club head 100 with a thin back.
Figure 1B:
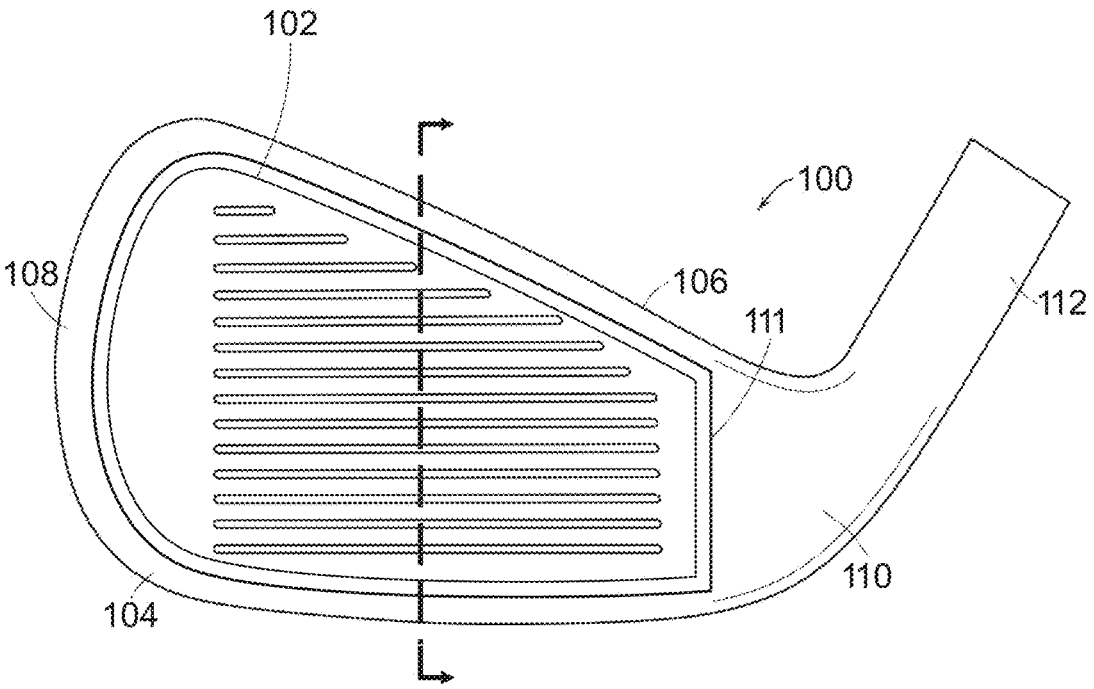
FIG. 1B depicts a front view of the example golf club head depicted in FIG. 1A.
Figure 1C:
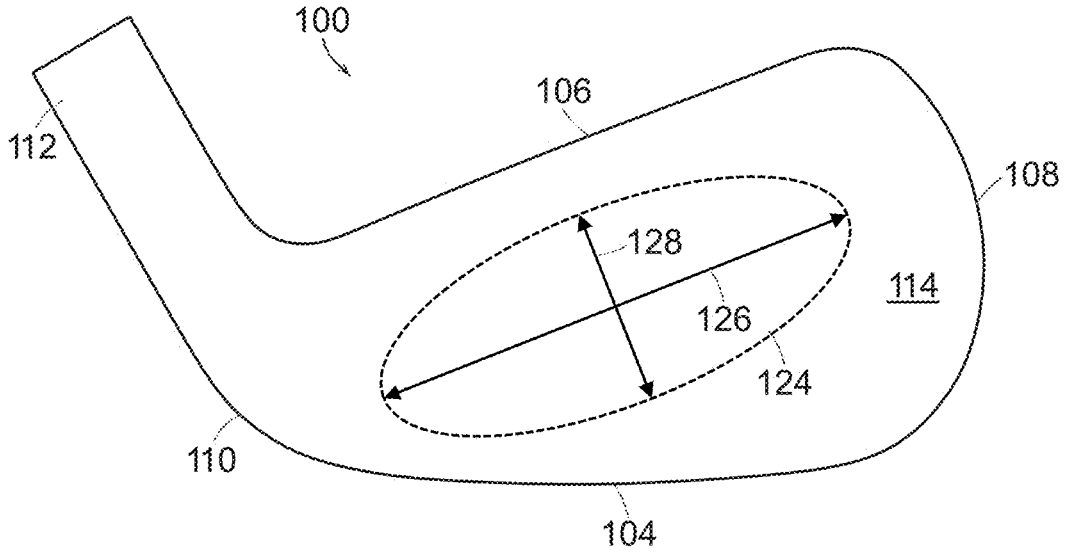
FIG. 1C depicts a back view of the example golf club head depicted in FIGS. 1A-1B.

FIG. 1A depicts a perspective view of an example polymer-filled hollow iron-type golf club head 100 with a thin back. FIG. 1B depicts a front view of the example golf club head 100 depicted in FIG. 1A, and FIG. 1C depicts a back view of the example golf club head 100 depicted in FIG. 1A. FIGS. 1A-1C are discussed concurrently. The golf club head 100 includes striking face 102, which is intended to strike a golf ball. The striking face 102 is connected to a top line portion 106, a toe portion 108, and a heel portion 110. The border between the heel portion 110 and the striking face 102 is the heel edge 111. The toe portion 108 and the heel portion 110 are also at least in part connected to the top line portion 106. The heel portion 110 is connected to a hose 112 that is configured to receive a shaft (not shown). The striking face 102 is also connected to a sole 104. The golf club head 100 also includes a back portion 114 that is attached at least partially to the sole 104, the topline, the toe portion 108, and the heel portion 110. A cavity is formed between the sole 104, the toe portion 108, the heel portion 110, the striking face 102, the topline portion 106, and the back portion 114. The cavity may be fully enclosed by the sole 104, the toe portion 108, the heel portion 110, the striking face 102, the topline portion 106, and the back portion 114. In some examples, the volume of the cavity may have a volume of about 10,000 cubic millimeters to 45,000 cubic millimeters.

The toe portion 108 may also include an injection port 118 to allow for polymer to be injected into the cavity. While the injection port 118 is depicted as being integrated into the toe portion 108, the injection port 118 may be integrated into other or different components of the golf club head 100.

The components of the golf club head 100, such as the striking face 102, the sole 104, the topline 106, the toe portion 108, the heel portion 110, and the back portion 106, may be of a metallic material, such as a steel. The components of the golf club head 100 may formed through a casting process. Some of the components may be cast a single piece and the remainder of the components may be attached subsequent to the casting process. For instance, the sole 104, the topline 106, the toe portion 108, the heel portion 110, and the back portion 106 may be cast a single piece. The striking face 102 may then be attached that single piece via welding or other suitable process for attaching two components to one another. In such an example, the striking face 102 may be an insert.

The striking face 102 has an impact area $A_I$. The United States Golf Association (USGA) defines the impact area $A_I$ for an iron, such as golf club head 100, as the part of the club where a face treatment has been applied (e.g., grooves, sandblasting, etc.) or the central strip down the middle of the club face having a width of 1.68 inches (42.67 mm), whichever is greater. For clubs where the striking face 102 is an insert, the boundary of the impact area is defined by the boundary of the insert, as long as any markings outside the boundary do not encroach the impact area by more than 0.25 inches (6.35 mm) and/or are not designed to influence the movement of the ball.

The back portion 114 portion of the golf club head 100 has an energy transfer area 124. The energy transfer area 124 is an area of the back portion 114 that has thickness characteristics selected to improve energy transfer in the golf club head 100 when the golf club head 100 strikes a golf ball. The energy transfer area 124 may be defined as an oval or circular area of the back portion 114 having a center point in the geometric center of the back portion 114, where the edge of the energy transfer area 124 is a minimum of about 6 mm away from the outer perimeter of the golf club head 100. For example, the energy transfer area 124 may have a major axis 126 and a minor axis 128. In the example depicted in FIG. 1C, the major axis 126 runs parallel to the topline portion 106. The minor axis 128 in that example thus runs orthogonal to the topline portion 106 and the major axis 126. The length of the major axis 126 and the minor axis 128 are set such that the edge of the energy transfer area 124 is at least about 6 mm apart from the outer perimeter of the golf club head 100. In other examples, the major axis 126 may run substantially parallel to the sole 104. In such examples, the center point of the energy transfer area 124 may still be at the geometric center of the back portion 114 and the length of the major axis 126 and the minor axis 128 may be selected such that the edge of the energy transfer area 124 is at least about 6 mm away from the outer perimeter of the golf club head 100. In other examples, the energy transfer area 124 may be substantially circular (e.g., the length of the major axis 126 is equal to the length of the minor axis 128). In such an example, the center point of the energy transfer area 124 may be located at the geometric center of the back portion 114 and the diameter of the energy transfer area 124 may be about 26 mm, which is about half the diameter of a golf ball. In other examples, the energy transfer area 124 may have a different shape, such as a quadrilateral having boundaries that are a minimum of about 6 mm away from the outer perimeter of the golf club head 100. In other examples, the energy transfer area 124 is an area of the back portion 114 that is equivalent to about 40-100%, 50-90%, 60%-70%, or about 65% of the area of the front of the striking face 102.

Figure 1D:
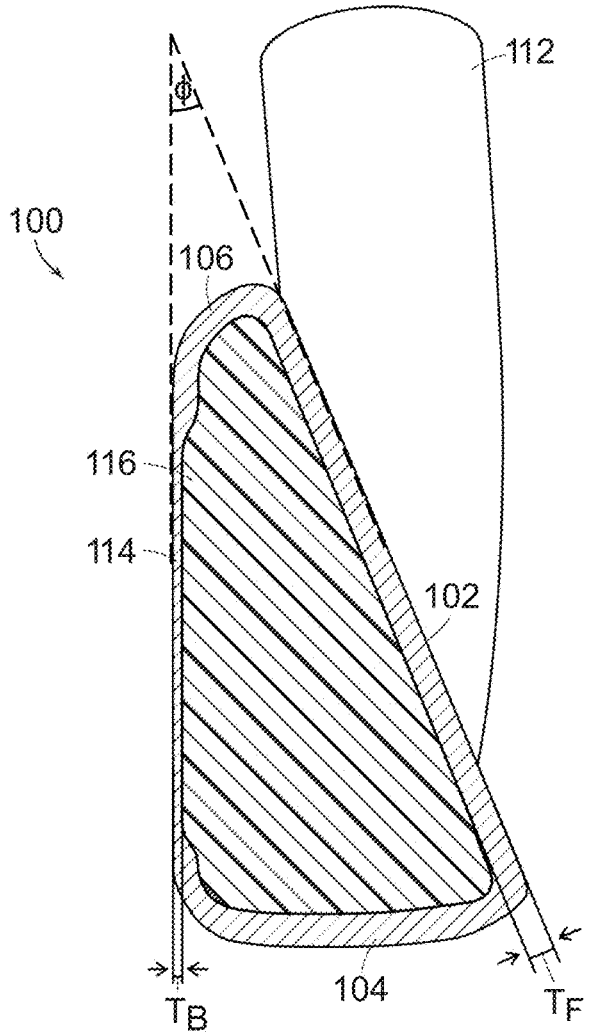
FIG. 1D depicts a section view of the example golf club head depicted in FIGS. 1A-1C.

FIG. 1D depicts a section view of the example golf club head 100, depicted in FIGS. 1A-1C, along the section line indicated in FIG. 1B. As shown in FIG. 1D, the interior cavity of the golf club head 100 is filled with a polymer 116. The polymer 116 is in contact with the interior surface of the striking face 102 and the interior surface of the back portion 114. Thus, when the striking face 102 strikes a golf ball, energy from the impact is transferred from the striking face 102 to the polymer 116, which transfers that energy to the back portion 114. The transfer of the impact energy thus causes the back portion 114 to flex with the polymer 116 and the striking face 102. Conventional wisdom suggested that filling the cavity with a polymer would significantly decrease the COR of the golf club head 100 because the deflection of the striking face 102 into the cavity would be limited or reduced by the polymer 116. The present technology introduces a thin back portion 114 that considerably reduces the loss in COR of the golf club head 100 when it is filled with the polymer 116. Such improved results are discussed further below with reference to FIGS. 4-6.

As shown in FIG. 1D, the striking face 102 has a face thickness $T_F$, and the back portion 114 has a back thickness $T_B$. In some examples, the striking face thickness $T_F$ may be variable, such as in variable face thickness (VFT) implementations. In such examples, the striking face 102 has a minimum striking face thickness $T_{Fmin}$, a maximum striking face thickness $T_{Fmax}$, and an average striking face thickness $T_{Favg}$. Similarly, the back portion 114 may also have a variable thickness $T_B$. In such examples, back portion 114 has a minimum back thickness $T_{Bmin}$, a maximum back thickness $T_{Bmax}$, and an average back thickness $T_{Bavg}$. The thickness $T_F$ of the striking face 102 may be discussed herein for the entire striking face 102 and/or the impact area $A_I$ of the striking face 102. In some examples, such as where the striking face 102 is an insert, the entire striking face 102 and the impact area $A_I$ of the striking face 102 may be the same. Similarly, the thickness $T_B$ of the back portion 114 may be discussed herein for the entire back portion 114 and/or the energy transfer area 124 of the back portion 114.

The face thickness $T_F$ of the striking face 102 may range from about 1.0 mm to about 3.0 mm. In some examples, the face thickness may be from about 1.2 mm to about 1.8 mm or from about 1.3 mm to about 1.7 mm. In other examples the face thickness may be greater than about 1.0 mm and less than about 2.0 mm. In specific examples, the face thickness may be about 1.35 mm, about 1.5 mm, or about 1.6 mm. In embodiments where the striking face 102 has a variable thickness, the above ranges for the face thickness may be ranges for the minimum striking face thickness $T_{Fmin}$, the maximum striking face thickness $T_{Fmax}$, or the average striking face thickness $T_{Favg}$. The above recited thickness ranges may also be for the impact area $A_I$ of the striking face 102. The face thickness has an effect on performance and may be selected based on the particular type of club that is being manufactured. For instance, a thinner striking face 102 may be less durable than a thicker striking face 102. Accordingly, golf clubs designed for golfers having slower swing speeds may have a thinner striking face 102 whereas golf clubs designed for golfers having higher swing speeds may require a thicker striking face 102 to prevent failures, such as cracks for fractures in the striking face 102. A thinner striking face 102 may also increase COR for the golf club head 100.

The back thickness $T_B$ of the back portion 114 may range from about 0.3 mm to about 1.5 mm. In some examples, the back thickness may range from about 0.4 mm to about 0.8 mm. In a specific example, the back thickness may be about 0.6 mm. In embodiments where the back portion 114 has a variable thickness, the above ranges for the back thickness may be ranges for the minimum back thickness $T_{Bmin}$, the maximum back thickness $T_{Bmax}$, and the average back thickness $T_{Bavg}$. The above recited thickness ranges for the back portion 114 may also be for the energy transfer area 124 of the back portion 114. The thickness of the back portion 114 has an effect on the performance of the golf club head 100. For instance, the thickness of the back portion 114 in relation to the thickness of the striking face 102 has an effect on the COR of the golf club head 100, as discussed further below with reference to FIGS. 4-6. In addition, the back thickness $T_B$ also has an effect on durability of the golf club head 100. A back thickness $T_B$ that is too low may be more likely to fail and thus reduce the durability of the golf club head 100. The back thickness $T_B$ may also be dependent on the type of polymer 116 that is used to fill the cavity of the golf club head 100.

The ratio between the face thickness $T_F$ and back thickness $T_B$, referred to herein as the face-to-back thickness ratio ($T_F$:$T_B$), also has an effect on the performance of the golf club. Certain ranges of the face-to-back thickness ratio ($T_F$:$T_B$) have been found to improve the COR of the golf club, while preserving durability characteristics of the golf club head 100. For example, face-to-back thickness ratios ($T_F$:$T_B$) between about 2:1 and 4:1 have been found to result in such improved performance characteristics. Face-to-back thickness ratios ($T_F$:$T_B$) between about 2:1 and about 3:1, such as about 5:2, have also been found to be particularly used in improving performance characteristics of the golf club head 100. It is believed that the functional relationship between the face thickness and the back thickness has not previously been recognized by those having skill in the art.

The type of polymer 116 and the amount of polymer 116 in the cavity also affects the performance of the golf club head 100. One property of the polymer 116 that affects the performance of the golf club head 100 is the hardness or rigidity of the polymer 116. For instance, if the polymer is too hard or rigid, durability of the back portion 114 may be reduced. In contrast, if the polymer is too soft or flexible, the durability of the striking face 102 may be reduced. A polymer 116 having a hardness between Shore 10 A and Shore 80 A has been found to be effective at producing an improved COR value while maintaining durability. Hardness values between Shore 20 A and Shore 60 A along with values between Shore 40 A and Shore 50 A have also been found to be effective. A polymer 116 having a Young's Modulus between about 40 megapascals (MPa) and about 120 MPa has been found to be effective at producing a high COR value while maintaining durability. Young's Modulus values between about 50 MPa and about 100 MPa have also been found to be effective. Specific examples of about 50 MPa, 80 MPa, and 100 MPa have been found to be effective with varying combinations of face-to-back thickness ratios ($T_F$:$T_B$).

The amount of polymer 116 in the cavity of the golf club head 100 also has an effect on the performance of the golf club head 100. Because the impact energy from striking a golf ball is transferred from the striking face 102 to the back portion 114 via the polymer 116, it is preferable that the polymer 116 substantially fills the cavity of the golf club head 100. For example, if the polymer 116 does not span from the striking face 102 to the back portion 114, the polymer 116 will not be able to transfer the impact energy during a strike of a golf ball. Accordingly, the polymer 116 may fill at least 70%, 80%, 90%, 95%, or 99% of the cavity of the golf club head 100 to allow for the impact energy transfer to occur.

As can also be seen from FIG. 1D, an angle (Φ) is formed between a plane of the striking face 102 and a plane of the back portion 114. The angle (Φ) is the angle between a plane that is substantially parallel to the striking face 102 and a plane that is substantially parallel to the back portion 114. The angle (Φ) changes depending on the loft of the iron. For instance, the angle (Φ) will different for a 3-iron than the angle (Φ) for a 9-iron. Generally, however, the angle (Φ) may range from about 5 degrees to about 80 degrees, and in some examples the angle (Φ) ranges from about 10 degrees to about 45 degrees. The back portion 114, or at least the energy transfer area 124 of the back portion 114, may be substantially planar such that it has minimal curvature.

Figure 2A:
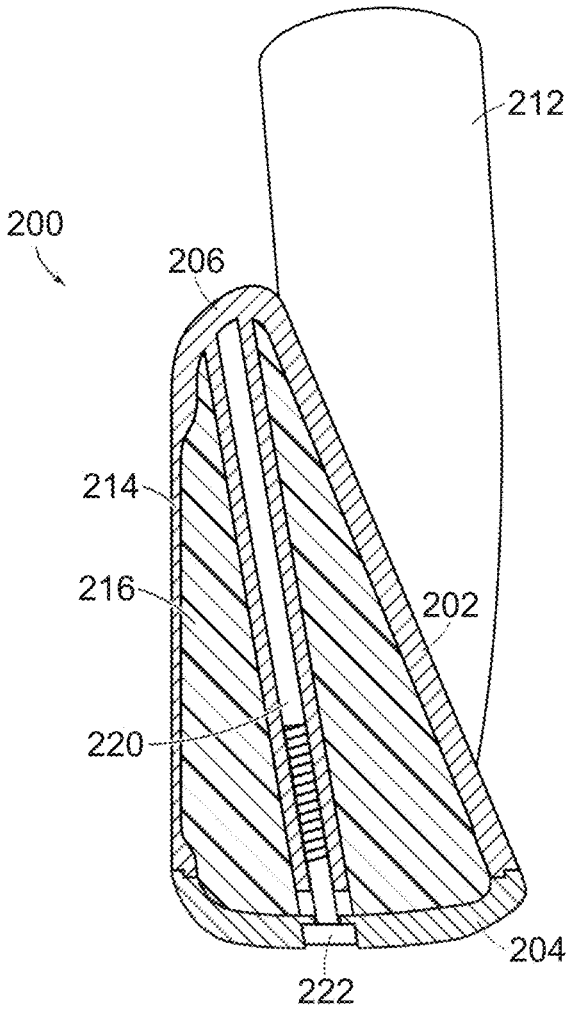
FIG. 2A depicts a section view of another example golf club head.
Figure 2B:
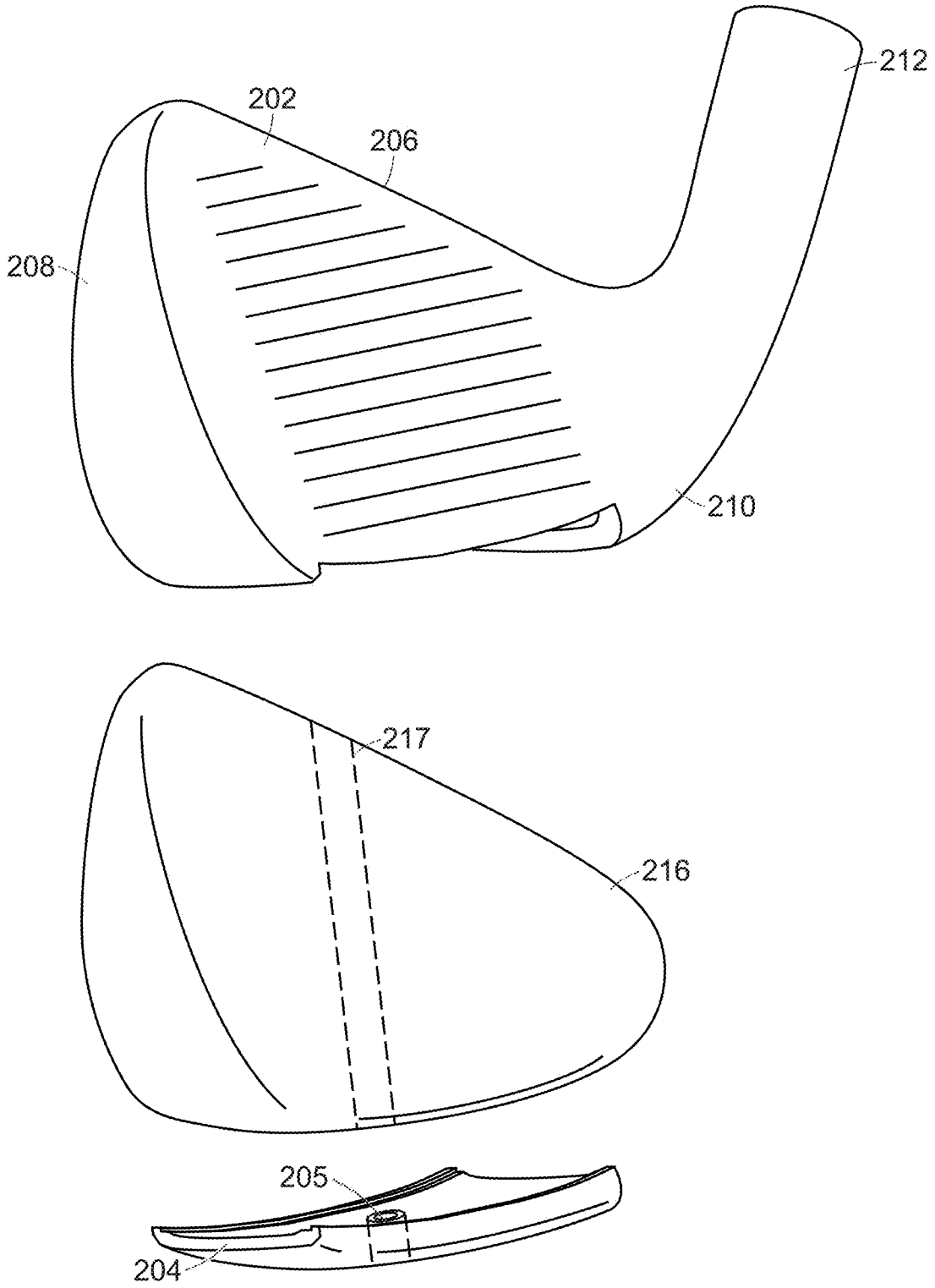
FIG. 2B depicts an exploded view of the example golf club head depicted in FIG. 2A.

FIG. 2A depicts a section view of another example golf club head 200, and FIG. 2B depicts an exploded view of the example golf club head depicted in FIG. 2A. FIGS. 2A-2B are discussed concurrently. Similar to the golf club head depicted in FIGS. 1A-1D, the golf club head 200 includes a toe portion 208, a heel portion 210, a striking face 202, a topline portion 206, and a back portion 214 that all may be configured similarly to the corresponding elements described above with reference to FIGS. 1A-1D. The example golf club head 200 depicted in FIGS. 2A-2B differs from the example golf club head 100 depicted in FIGS. 1A-1D in that the golf club head 200 includes a detachable sole 204 that allows for a polymer insert 216 to be inserted into the cavity of the golf club head 200.

The golf club head 200 includes an attachment post that extends from the topline portion 206 into the cavity towards to the detachable sole 204. The attachment post 220 is configured to engage a fastener 222. For instance, the attachment post 220 may include internal threading that receives the fastener 222 in the form of a screw. In other examples, the attachment post 220 includes external threading and the fastener 222 may include internal threading such that the attachment post 220 may be received into the fastener 222. The attachment post 220 may be substantially centered between the toe portion 208 and the heel portion 210.

The polymer insert 216 is shaped to substantially match the contours of the cavity of the golf club head 200 such that the polymer insert 216 may be inserted into the cavity. Accordingly, the polymer insert 216 is pre-formed prior to being inserted in the cavity. The polymer insert 216 may also include a through-hole 217 to accommodate the attachment post 200 when the polymer insert 216 is inserted into the cavity. For instance, as the polymer insert 216 is inserted into the cavity, the attachment post 220 passes through the through-hole 217 in the polymer insert 216.

The detachable sole 204 also includes a through-hole 205 to accommodate the fastener 222. Once the polymer insert 216 has been inserted into the cavity, the detachable sole 204 is aligned with the bottom of the striking face 202, the back portion 214, the toe portion 208, and the heel portion 210 of the golf club head 200. The fastener 222 is then inserted through the through-hole 205 of the sole 204 such that it engages the attachment post 220. For instance, in examples where the fastener 222 is a screw, the fastener 222 is inserted into the attachment post 220 and turning of the fastener 222 fastens the detachable sole 204 to the remainder the golf club head 200.

In some examples, fastening the detachable sole 204 to the remainder of the golf club head 200 compresses the polymer insert 216. In such examples, the compression of the polymer insert 216 may result in a preload being applied by the polymer insert 216 against the rear surface of the striking face 202. For instance, the volume of the polymer insert 216 may be larger than the volume of the cavity of the golf club head 200. In other examples, a dimension of the polymer insert 216 in a direction from the striking face 202 to the back portion 214 may be larger than an equivalent dimension of the cavity. As a result, attachment of the detachable sole 204 compresses the polymer insert 216. Tightening of the fastener 222 further compresses the polymer insert 216 until the detachable sole 204 is fully attached to the remainder of the golf club head 200. In some examples, the polymer insert may fill at least 70%, 80%, 90%, 95%, or 99% of the cavity of the golf club head 200.

In general, the thicknesses of the striking face 202 and the back portion 214 may be the same as those discussed above with reference to the corresponding thicknesses in golf club head 100 depicted in FIG. 1D. In some examples where attachment of the detachable sole 204 compresses the polymer insert 216 to create a preload on the rear surface of the striking face 202, however, the thickness of the back portion 214 may also be the same or greater than the thickness of the striking face 202. While the detachable sole 204 is described as being detachable, in some examples the detachable sole 204 may be permanently attached to the remainder of the club head body 200 after being initially fastened via the fastener 222.

Figure 3:
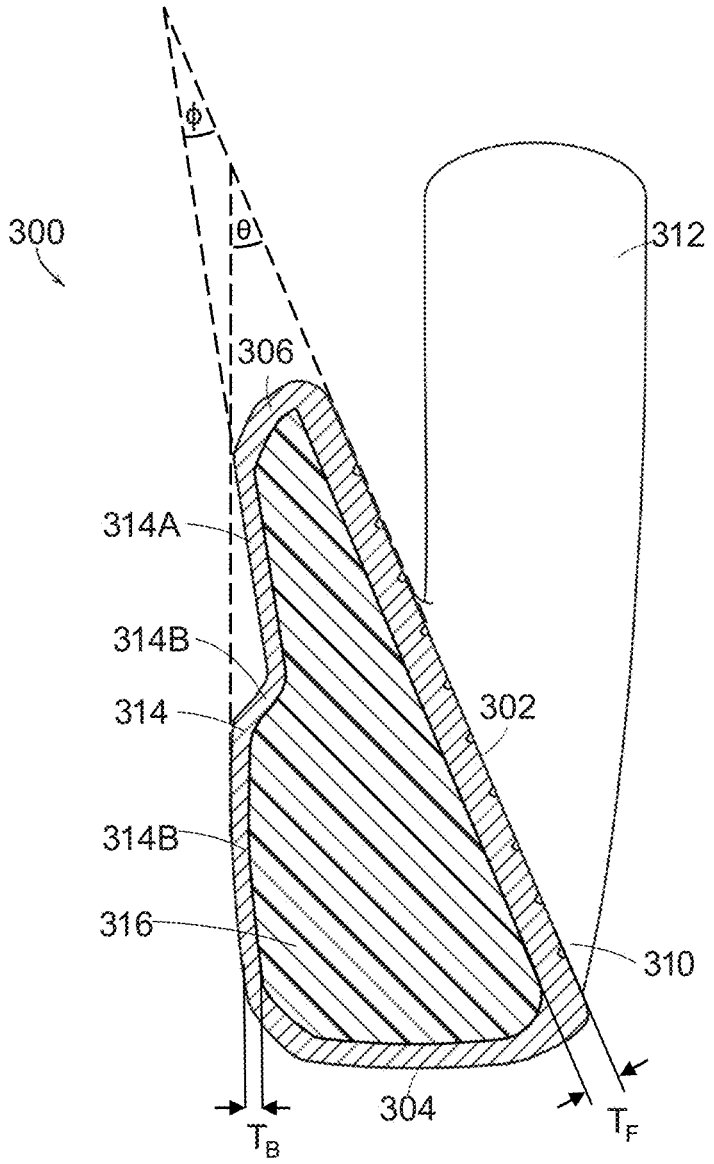
FIG. 3 depicts a section view of another example golf club head.

FIG. 3 depicts another example golf club head 300. The golf club head 300 is substantially similar to the example golf club head 100 depicted in FIGS. 1A-1D with the exception that the back portion 314 in example golf club 300 has a different form. Like the golf club head 100 depicted in FIGS. 1A-1D, the golf club head 300 includes a includes a sole 304, a toe portion 308, a heel portion 310, a striking face 302, a topline portion 306, and a back portion 314 that all may be configured similarly to the corresponding elements described above with reference to FIGS. 1A-1D. For instance, a cavity is defined by sole 304, the toe portion 308, the heel portion 310, the striking face 302, the topline portion 306, and the back portion 314. That cavity is filled with a polymer 316. The polymer 316 may have the same characteristics as polymer 116 discussed above. In addition, the striking face 302 is substantially similar to the striking face 102 depicted in FIGS. 1A-1D, and the striking face 302 may have the same thickness discussed above with reference to striking face 102.

The back portion 314 in golf club head 300 has a first planar portion 314A and a second planar portion 314C connected to the first planar portion 314A by a transition portion 314B. The first planar portion 314A extends from the topline portion 306 to the transition portion 314B. The second planar portion 314C extends from the transition portion 314B to the sole 304. In some examples, the first planar portion 314A may be about 50% of the area of the back portion 314, and the second planar portion 314C may be about 50% of the area of the back portion 314. In other examples, the first planar portion 314A may be about 70% of the area of the back portion 314, and the second planar portion 314C may be about 30% of the area of the back portion 314.

A first angle (Φ) is formed between a plane of the striking face 302 and a plane of the first planar portion 314A. For instance, the first angle (Φ) is the angle between a plane that is substantially parallel to the striking face 102 and a plane that is substantially parallel to the first planar portion 314A. The first angle (Φ) may range from about 5 degrees to about 80 degrees, and in some examples the first angle (Φ) ranges from about 10 degrees to about 45 degrees.

A second angle (θ) is formed between a plane of the striking face 302 and a plane of the second planar portion 314C. For instance, the second angle (θ) is the angle between a plane that is substantially parallel to the striking face 302 and a plane that is substantially parallel to the second planar portion 314C. The second angle (θ) may range from about 5 degrees to about 80 degrees, and in some examples the second angle (θ) ranges from about 10 degrees to about 45 degrees. The second angle (θ) may be greater than the first angle (Φ). For instance, second angle (θ) may be about 5 degrees to about 30 degrees greater than the first angle (Φ). In other examples, the second angle (θ) may be about 5 degrees to about 15 degrees greater than the first angle (Φ).

The first planar portion 314A, the transition portion 314B, and the second planar portion 314C each have a back thickness $T_B$. The back thickness $T_B$ of the first planar portion 314A may be different or the same as the back thickness $T_B$ of the second planar portion 314C. In some examples, the first planar portion 314A and/or the second planar portion 314C may have a variable thickness. In such examples, each planar portion has a minimum back thickness $T_{Bmin}$, a maximum back thickness $T_{Bmax}$, and an average back thickness $T_{Bavg}$.

The back thickness $T_B$ of the first planar portion 314A and/or the second planar portion 314C may range from about 0.3 mm to about 1.5 mm. In some examples, the back thickness $T_B$ of the first planar portion 314A and/or the second planar portion 314C may range from about 0.4 mm to about 0.8 mm. In a specific example, the back thickness $T_B$ of the first planar portion 314A and/or the second planar portion 314C may be about 0.6 mm. In embodiments where the first planar portion 314A and/or the second planar portion 314C has a variable thickness, the above ranges for the back thickness may be ranges for the minimum back thickness $T_{Bmin}$, the maximum back thickness $T_{Bmax}$, and the average back thickness $T_{Bavg}$. In addition, the first planar portion 314A and/or the second planar portion 314C may have face-to-back thickness ratios ($T_F$:$T_B$) between about 2:1 and 4:1. Face-to-back thickness ratios ($T_F$:$T_B$) may also be between about 2:1 and about 3:1, such as about 5:2.

Figure 4:
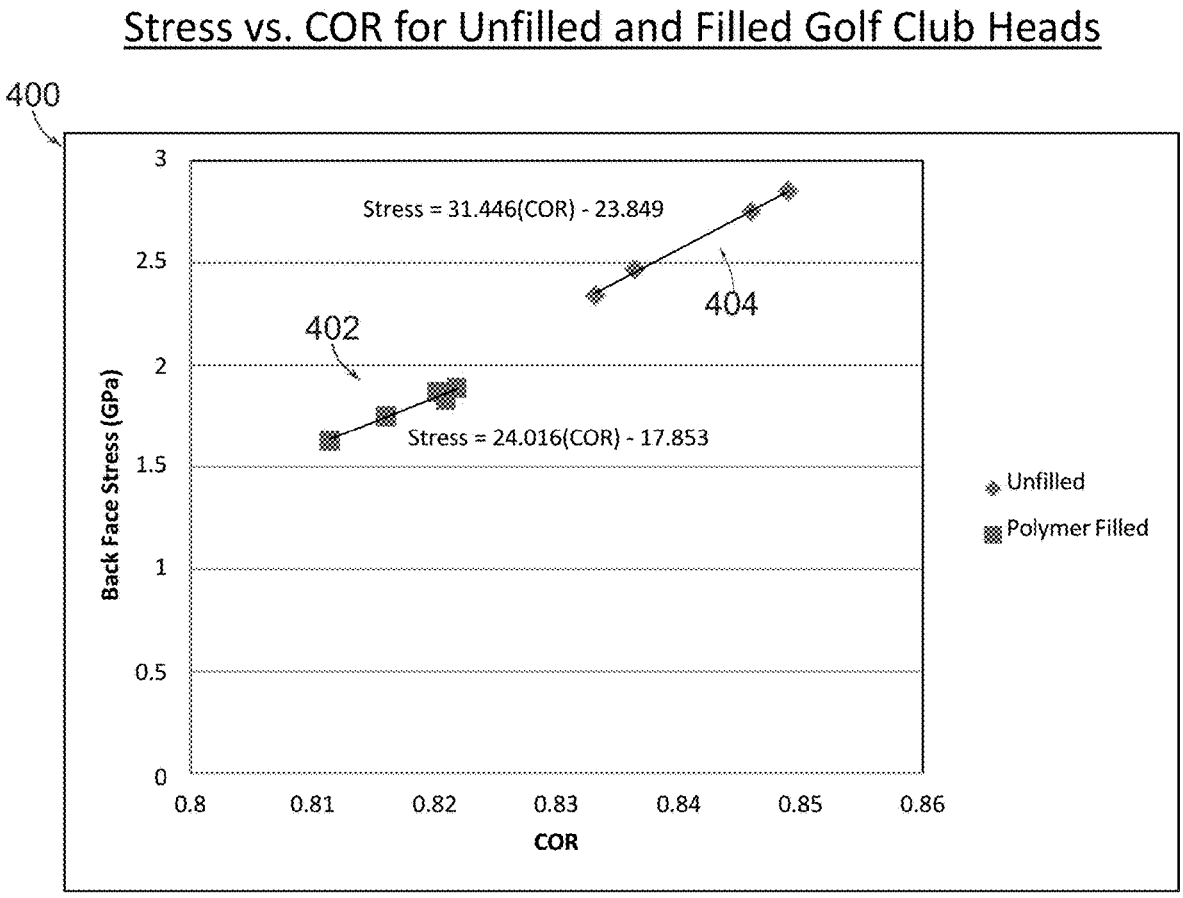
FIG. 4 depicts a plot of stress versus COR for unfilled and filled golf clubs.

FIG. 4 depicts a plot 400 of stress versus COR for unfilled and filled golf clubs. The plot includes a first collection of results 402, represented by squares, for a golf club head filled a polymer having a thin back according to examples of the present technology. The plot also includes a second collection of results 404, represented by diamonds, for a substantially similar golf club without a polymer filling the cavity (e.g., an "unfilled golf club head"). The y-axis of the plot represents stress on the back of the striking face during a strike of a golf ball. The units of stress are represented in gigapascals (GPa). The x-axis represents the COR of the golf club head. COR values are unitless.

Based on the results in the plot 400, a trendline for the polymer-filled golf club head collection of results 402 may be represented by the following equation: Stress=24.016 (COR)−17.853. The trendline for the unfilled golf club head collection of results 404 may be represented by the following equation: Stress=31.446(COR)−23.849. The trendlines show that for golf club having a COR greater than 0.806, the polymer-filled golf club head will incur a lower stress on the face for a golf ball strike. As an example, for a golf club having a COR of 0.822, the unfilled golf club incurs a face stress of 2.0 GPa, whereas the polymer-filled golf club incurs a face stress of 1.89 GPa. As such, the polymer-filled golf club is more durable than the unfilled golf club head, especially at high COR values.

Figure 5:
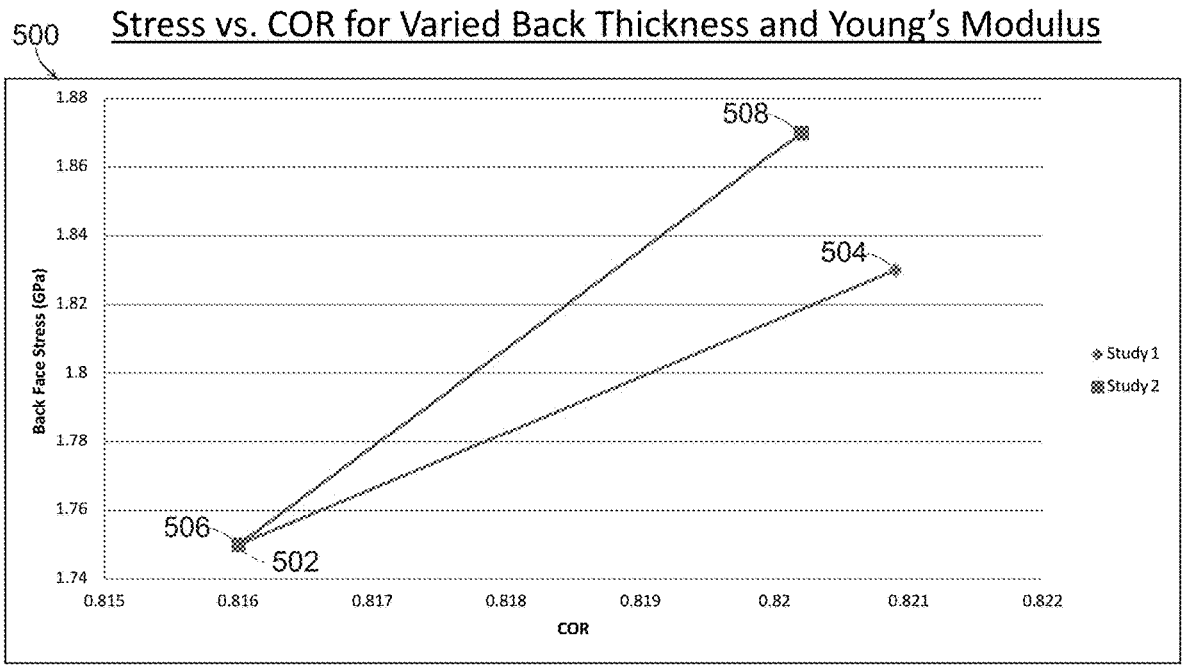
FIG. 5 depicts a plot of stress versus COR for varied back thicknesses and polymers.

FIG. 5 depicts a plot 500 of stress versus COR for varied back thicknesses and polymers. Two studies were conducted. In the first study (Study 1), the back thickness of the golf club head was altered, and the respective golf club heads were analyzed. The results of Study 1 are represented in the plot 500 as diamonds. At point 502 in the plot 500, a golf club head having a face thickness of 1.35 mm, a back thickness of 1.0 mm, and filled with a polymer having a Young's Modulus value of 100 MPa was analyzed. As shown in the plot 500, that golf club head had a COR of 0.816 and incurred a stress of the back of the face of 1.75 GPa when striking a golf ball. At point 504, a golf club having a face thickness of 1.35 mm, a back thickness of 0.55 mm, and filled with a polymer have a Young's Modulus value of 100 MPa was analyzed. As shown in the plot 500, that golf club head had a COR of 0.821 and incurred a stress on the back of the face of 1.83 GPa when striking a golf ball.

In the second study (Study 2), the type of polymer used to the fill the golf club head was altered, and the respective golf club heads were analyzed. More specifically, polymers having different Young's Modulus values were tested. At point 506 in the plot 500, the same golf club that was analyzed at point 502 was analyzed, and the results were the same. At point 508, a golf club having a lower Young's Modulus was analyzed. More specifically, at point 508, a golf club having a face thickness of 1.35 mm, a back thickness of 1.0 mm, and filled with a polymer having a Young's Modulus value of 80 MPa was analyzed. As shown in the plot 500, that golf club head had a COR of 0.82 and incurred a stress on the back of the face of 1.87 when striking a golf ball.

Effectively, three golf club heads were tested between those two studies. The results can be seen in the plot 500 and the results are also summarized in Table 1, below:

TABLE 1

| | Club Head 1 (Points 502/506) | Club Head 2 (Point 504) | Club Head 3 (Point 508) |
|---|---|---|---|
| Face Thickness | 1.35 mm | 1.35 mm | 1.35 mm |
| Back Thickness | 1.0 mm | 0.55 mm | 1.0 mm |
| Polymer Young's Modulus | 100 MPa | 100 MPa | 80 MPa |
| COR | 0.816 | 0.821 | 0.82 |
| Back-Face Stress | 1.75 GPa | 1.83 GPa | 1.87 GPa |

From the results, it can be seen that lowering the back thickness provides more favorable results than lowering the Young's Modulus of the polymer that fills the golf club head. For instance, thinning the back portion of the golf club results in a higher gain in COR with a smaller increase in stress, which results in a golf club that is more durable and has better performance characteristics.

Table 2, below, depicts results of another study of four different golf club heads. The results shown in Table 2 demonstrate an unexpected effect that is greater than the sum of each of the effects or modifications taken separately. In particular, as discussed in further detail below Table 2, manufacturing an iron with a thin back that is filled with a polymer provides for a golf club head having a COR that is greater than the sum of the results of solely a thin back and solely a polymer filling. As such, a previously unknown synergism between the thin back and the polymer filling has been discovered and demonstrated. In fact, filling the club head with a polymer generally decreases the COR of a golf club head, but with the addition of a thin back, the magnitude of the decrease in COR is considerably reduced.

TABLE 2

| Property/Feature | Club Head 1 | Club Head 2 | Club Head 3 | Club Head 4 |
|---|---|---|---|---|
| Club Head Type | Unfilled Iron | Thin-Back Unfilled Iron | Base Filled Iron | Thin-Back Filled Iron |
| Face Thickness | 1.50 mm | 1.50 mm | 1.50 mm | 1.50 mm |
| Back Thickness | 1.1 mm | 0.55 mm | 1.1 mm | 0.55 mm |
| Polymer Young's Modulus | N/A | N/A | 50.00 MPa | 50.00 MPa |
| COR | 0.849 | 0.855 | 0.808 | 0.821 |

The golf club heads in Table 2 were based on modifications to a Titleist 718 T-MB 4-iron from the Acushnet Company of Fairhaven, Mass. The results in Table 2 were obtained through finite-element analysis (FEA). The first golf club head (Club Head 1) is a hollow iron that has no polymer filling. That golf club displayed a COR of 0.849. The second golf club head (Club Head 2) is a modified version of Club Head 1 with the back portion thinned to 0.55 mm. Thinning of the back portion in Club Head 2 increased the COR to 0.855 (i.e., an increase in COR of 0.006). The third golf club head (Club Head 3) is a modified version of Club Head 1 with the club head filled with a polymer having a Young's Modulus value of 50.00 MPa. Filling the club head in Club Head 2 decreased the COR to 0.808 (i.e., a decrease in COR of 0.041). Accordingly, one would expect that thinning the back of an iron would increase the COR, but filling an iron with a polymer would reduce the COR. Specifically, based on the results from Club Heads 1-3, thinning the back portion should increase the COR by 0.006 and filling the club head with a polymer should reduce the COR by 0.041. The expected net change in COR for a polymer-filled iron with a thin back is thus a decrease in COR by 0.035. Surprisingly, however, a polymer-filled iron with a thin back unexpectedly decreases the COR by significantly less than the expected 0.035, which is demonstrated by the fourth golf club head (Club Head 4) analyzed in Table 2. Club Head 4 is a modified version of Club Head 1 with the back portion thinned to 0.55 mm and filled with a polymer having a Young's Modulus value of 50.00 MPa. Thinning the back portion in combination with filling the club head decreased the COR to 0.821 (i.e., a decrease in COR of 0.028). As such, while the expected decrease in COR was 0.035, the actual decrease in COR was only 0.028—resulting in an unexpected 20% improvement in COR due to the synergy between the thin back and the polymer filling. As a result, the present technology provides a solution for filling a golf club head with a polymer to improve durability while still maintaining a considerably higher COR. The relative changes in COR between the analyzed club heads are shown below in Table 3.

TABLE 3

| Club Head Number | Relative Change in COR to Club Head 1 |
|---|---|
| Club Head 2 (Thin-Back Unfilled Iron) | 0.0006 |
| Club Head 3 (Filled Base Iron) | −0.041 |
| Club Head 4 (Thin-Back Filled Iron) | −0.028 |

FIG. 6 depicts another table of data for filled and unfilled irons with varying thicknesses of the striking face and the back portion. In the table depicted in FIG. 6, nine different golf club heads were analyzed using FEA. Golf club heads 1-5 were filled with a polymer, and golf club heads 6-9 were unfilled. These results continue to demonstrate that having a polymer-filled golf club head with a thin back portion preserves COR while also providing increased durability by reducing the stress on the back of the striking face. The table of data in FIG. 6 also includes a spring factor for the respective club head configurations. The spring factor may be determined by the following equation:

$$S = (3.8)\frac{T_F}{0.1} + (1.09)\frac{T_B}{0.1} + (0.21)E$$

In the above equation, S represents the spring factor, $T_F$ represents the thickness of the striking face in the millimeters, $T_B$ represents the thickness of the back portion in millimeters, and E is the Young's modulus of the polymer filling in megapascals (MPa). The thickness values and Young's Modulus values in the above equation may be unitless so that the values may be added together to result in a unitless spring factor. In examples where the striking face or the back portion has a variable thickness, the thicknesses in the above equation may be the average thicknesses for the respective components. Finite element analysis has indicated that, in some examples, a spring factor of less than or equal to about 80 provides improved performance characteristics while still maintaining acceptable durability. Accordingly, some examples of golf club heads according to the present technology have a face thickness, a back thickness, and a Young's Modulus of the polymer selected to have the spring factor of the golf club head be less than or equal to about 80.

This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art. Further, as used herein and in the claims, the phrase "at least one of element A, element B, or element C" is intended to convey any of: element A, element B, element C, elements A and B, elements A and C, elements B and C, and elements A, B, and C. Further, one having skill in the art will understand the degree to which terms such as "about" or "substantially" convey in light of the measurements techniques utilized herein. To the extent such terms may not be clearly defined or understood by one having skill in the art, the term "about" shall mean plus or minus ten percent.

Although specific embodiments are described herein, the scope of the technology is not limited to those specific embodiments. Moreover, while different examples and embodiments may be described separately, such embodiments and examples may be combined with one another in implementing the technology described herein. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

The invention claimed is:

1. An iron-type golf club head comprising:

a sole;

a toe portion attached at least partially to the sole;

a heel portion attached at least partially to the sole;

a striking face attached at least partially to the sole, the striking face having a maximum face thickness;

a topline portion attached at least partially to the toe portion, the heel portion, and the striking face;

a substantially planar back portion attached at least partially to the topline portion and sole, wherein the back portion has a maximum back thickness less than the maximum face thickness and an angle between the striking face and the back portion is between about 10 degrees to about 45 degrees; and a cavity formed between the sole, the toe portion, the heel portion, the striking face, the topline portion, and the back portion, wherein the cavity is substantially filled with a polymer material;

wherein the iron-type golf club head has a spring factor of less than or equal to about 80, wherein the spring factor is calculated based on the following equation:

$$S = (3.8)\frac{T_F}{0.1} + (1.09)\frac{T_B}{0.1} + (0.21)E,$$

where S represents the spring factor, $T_F$ represents an average thickness of the striking face in millimeters, $T_B$ represents an average thickness of the back portion in millimeters, and E is the Young's modulus of the polymer material in megapascals (MPa).

2. The golf club head of claim 1, wherein a ratio between the maximum face thickness and the maximum back thickness is between about 2:1 and 3:1.

3. The golf club head of claim 1, wherein the maximum face thickness is about 1.5 mm and the maximum back thickness is about 0.6 mm.

4. The golf club head of claim 1, wherein the average face thickness is greater than the average back thickness.

5. The golf club head of claim 1, wherein the polymer material is an injected material that fills at least 95% of the cavity.

6. The golf club head of claim 1, wherein the polymer material has a hardness between Shore 20 A and Shore 60 A.

7. The golf club head of claim 1, further comprising an attachment post extending from the topline portion towards the sole, the attachment post configured to attach the sole to at least one of the striking face, the back portion, the toe portion, or the heel portion.

8. The golf club head of claim 7, wherein:

the attachment post includes an internal threading to receive a screw; and the sole defines a through hole configured to receive the screw, such that tightening of the screw into the internal threading of the attachment post causes the sole compress the polymer material.

9. The golf club head of claim 7, wherein the polymer material is a pre-formed polymer shaped to be inserted into the cavity prior to attachment of the sole to the golf club head.

10. The golf club head of claim 7, wherein the attachment post is substantially centered between the toe portion and the heel portion.

11. The golf club head of claim 1, wherein:

the back portion includes an energy transfer area centered at a geometric center of the back portion, wherein the energy transfer area has an area of 50-90% of an area of a front of the striking face, has an average thickness between 0.4 mm and 0.8 mm, and is defined by a major axis running parallel to the topline and a minor axis running perpendicular to the major axis; and the average thickness of the striking face is greater than 1 mm.

12. An iron-type golf club head comprising:

a striking face having a face thickness;

a topline portion attached at least partially to the striking face;

a toe portion attached at least partially to the topline portion;

a heel portion attached at least partially to the topline portion;

a back portion attached at least partially to the topline portion, wherein the back portion has a back thickness and an angle between the striking face and the back portion is between about 10 degrees to about 45 degrees, a cavity formed between the toe portion, the heel portion, the striking face, the topline portion, and the back portion;

an attachment post extending from the topline portion into the cavity;

a fastener configured to be engage the attachment post;

a pre-formed polymer inserted into the cavity; and a sole configured to receive the fastener such that tightening of the fastener causes the sole to compress the pre-formed polymer.

13. The golf club head of claim 12, wherein the attachment post is substantially centered between the toe portion and the heel portion.

14. The golf club head of claim 12, wherein the fastener is a screw and the attachment post includes an internal threading to receive the screw.

15. The golf club head of claim 12, wherein compression of the pre-formed polymer causes a preload on the striking face.

16. The golf club head of claim 12, wherein the pre-formed polymer fills at least 95% of the cavity.

17. The golf club head of claim 12, wherein a ratio between the face thickness and the back thickness is between about 2:1 and 3:1.

18. The golf club head of claim 17, wherein the ratio between the face thickness and the back thickness is about 5:2.

19. The golf club head of claim 18, wherein the face thickness is about 1.5 mm and the back thickness is about 0.6 mm.

20. A golf club head comprising:

a striking face having a maximum face thickness;

a topline portion attached at least partially to the striking face;

a toe portion attached at least partially to the topline portion;

a heel portion attached at least partially to the topline portion;

a substantially planar back portion attached at least partially to the topline portion, wherein a ratio between the maximum face thickness of the striking face and a maximum back thickness of the back portion is between about 2:1 and 3:1 and wherein an angle between the striking face and the back portion is between about 10 degrees to about 45 degrees;

a cavity formed between the toe portion, the heel portion, the striking face, the topline portion, and the back portion;

an attachment post extending from the topline portion into the cavity;

a fastener configured to be received by the attachment post;

a pre-formed polymer inserted into the cavity; and a sole configured to receive the fastener such that tightening of the fastener compresses the pre-formed polymer.

* * * * *